United States Patent [19]

Anop

[11] 3,971,100

[45] July 27, 1976

[54] AUXILIARY DOOR LOCK

[76] Inventor: Ivan Anop, 639 Tuscarawas Ave., Barberton, Ohio 44203

[22] Filed: Mar. 6, 1975

[21] Appl. No.: 555,863

Related U.S. Application Data

[63] Continuation-in-part of Ser. No. 474,517, May 30, 1974, abandoned.

[52] U.S. Cl. ..... 16/82; 292/DIG. 17; 16/50; 16/137; 16/80

[51] Int. Cl.[2] ..... E05F 5/02

[58] Field of Search ..... 292/DIG. 17, 341.12; 16/137, 191, 50, 128 R, 49, 65, 71, 80, 82, 85, 86 B, 86 C

[56] References Cited

UNITED STATES PATENTS

| | | | |
|---|---|---|---|
| 812,476 | 2/1906 | Becker | 292/DIG. 17 |
| 1,911,622 | 5/1933 | Humphrey | 292/DIG. 17 |
| 2,237,148 | 4/1941 | Kaptuller | 16/137 |
| 2,638,620 | 5/1953 | Civitelli | 16/137 |
| 3,157,906 | 11/1964 | Wolf | 16/50 |
| 3,174,179 | 3/1965 | Benson | 16/86 B |
| 3,206,793 | 9/1965 | Silverberg | 16/137 |
| 3,518,714 | 7/1970 | Weiner | 16/80 |

*Primary Examiner*—G. V. Larkin

[57] ABSTRACT

An auxiliary lock is disclosed which is intended to be used as a night lock in combination with the hinge of a conventional door. The device includes an elongated cross bar and a plurality of adjustable stop members which project from and are threadedly received in said cross bar and are adapted to engage the surface of the door and the door jamb or wall. The cross bar also carries a spring-loaded connecting means which is adapted to be engaged with the hinge pin of a conventional door hinge to thereby hold the cross bar in place on the hinge and the stop members in engagement with the door and door jamb. The bar is pivotally connected to the hinge pin by the connecting means so that it may be rotated 90° to permit normal operation of the door, and in this regard secondary stop members are provided to function as normal door stop members when the device is in its inoperative or unlocked position. The spring-loaded connecting means also includes a threaded handle which permits lessening of the spring tension to permit partial opening of the door without removal of the lock.

7 Claims, 5 Drawing Figures

AUXILIARY DOOR LOCK

RELATED APPLICATIONS

This application is a continuation-in-part of my earlier filed application Ser. No. 474,517 filed May 30, 1974 and now abandoned.

BACKGROUND OF THE INVENTION

This invention relates, in general, to auxiliary locking means intended to be utilized with conventional doors and, in particular, relates to a night lock which can be mounted on the hinge pin of the door and which can also be moved to an inoperative or unlocked position if desired.

DESCRIPTION OF THE PRIOR ART

The following patent prior art is known to Applicant:

Becker U.S. Pat. No. 812,476
Humphrey U.S. Pat. No. 1,911,622
Kaptuller U.S. Pat. No. 2,237,148
Civitelli U.S. Pat. No. 2,638,620
Wolf U.S. Pat. No. 3,157,906
Silverberg U.S. Pat. No. 3,206,793

This art shows various forms of door stops which, while not truly locks, do show some adjustment features. Silverberg U.S. Pat. No. 3,206,793 does show a night lock for a door, and while the reference may well be operative for its intended purpose, it is believed that it does lack the versatility of the present invention particularly with regard to the spring loaded connecting means, the adjustability of the stop means, and the rotatable feature which permits the present device to be moved from an operative to an inoperative position without disassembly.

SUMMARY OF THE INVENTION

As noted above, this invention relates to an auxiliary locking device which can be applied to the hinge pin of a conventional door.

It has been discovered that a device of this nature can be constructed by providing an elongated rigid cross bar having a plurality of adjustable stop members protruding from one surface thereof and adapted to engage the face of the door and the door jamb to thereby prohibit opening of the door.

It has also been discovered that a device of this nature can be provided with connecting means consisting of an elongated rod carried by the cross bar in spring-loaded condition and having a through aperture on one end thereof which is adapted to be engaged with the hinge pin of the door. It has been found that in this fashion the device can readily be installed on any conventional hinge.

It has also been found that if the connecting means is rotatably carried by the cross bar, it is possible to pivot the cross bar 90° so as to permit normal operation of the door. In this regard it has also been found advantageous to provide secondary stop means which serve as conventional door stops when the device is in the rotated position.

Furthermore, it has been discovered that if the connecting means are spring-loaded so as to normally urge the cross bar and the stop members into engagement with the door and the adjacent wall surface, it is possible to provide a threaded handle member which can be adjusted so as to permit partial opening of the door, if desired.

Accordingly, production of an improved auxiliary lock of the character above-described becomes the principal object of this invention, with other objects thereof becoming more apparent upon a reading of the following brief description, considered and interpreted in view of the accompanying drawings.

DESCRIPTION OF THE PREFERRED EMBODIMENT

Figure 1:
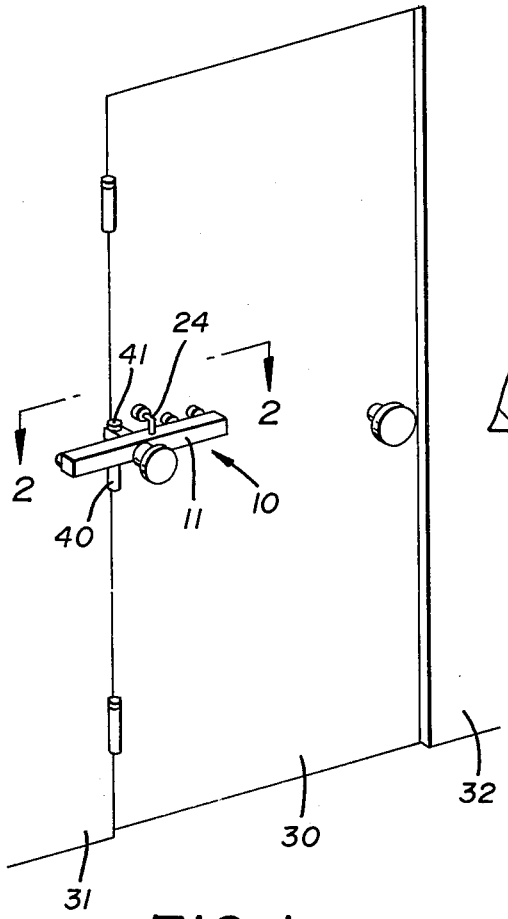
FIG. 1 is a perspective view showing the improved auxiliary lock in place on the door hinge.
Figure 2:
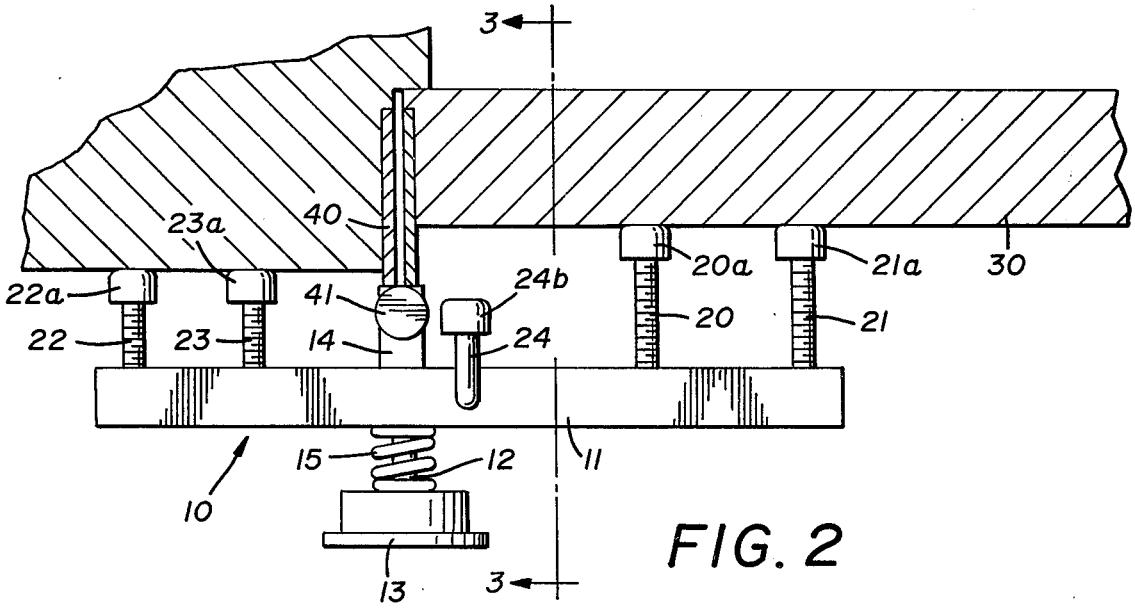
FIG. 2 is a sectional view taken along the line 2—2 of FIG. 1.

Referring first to FIGS. 1 and 2, it will be noted that the auxiliary lock, generally indicated by the numeral 10, comprises basically an elongated cross bar 11, a plurality of stop members 20, 21, 22, 23, and 24, and connecting means 12, 13, 14, and 15.

Considering FIG. 2 for a more detailed description of the overall device, it will be noted that cross bar 11 has a plurality of tapped and threaded holes in one surface thereof. On one end stop members 20 and 21, which are complementally threaded, are received in two of said apertures and project from the bar. These stop members 20 and 21 carry softened caps of rubber or similar material **20*a* and 21*a*, and these are intended to contact the face of the door 30** and prevent damage thereto. By virtue of the fact that the stop members are adjustable, the device is capable of utilization with doors having various size hinges, as well as varying degrees of offset between the door and the adjacent wall surface.

On the opposed end of the bar 11, stop members 22 and 23 are received in appropriate apertures. These members are also threaded and adjustable as described before with regard to stop members 20 and 21. Stop members 22 and 23 also carry rubber or other protective caps **22*a* and 23*a* which are intended to contact the wall surface 31** or the door jamb, as the case may be, and to prevent damage thereto.

Located on bar 11 between stop members 20 and 21 and 22 and 23 are the connecting means which include an elongated rod 12 which is threaded as at **12*a* and freely passed through a through aperture 11*a* in the cross bar 11. On one end of the rod 12 a handle member 13 is threadedly attached to the rod 12 and, disposed between the handle member 13 and the cross bar 11, is a spring 15 which encircles rod 12 and which normally urges the cross bar toward the door 30 and wall 31.**

Disposed on the opposed end of the rod 12 is a connector 14 which has a through aperture of sufficient size to enable a hinge pin 41 of hinge 40 to pass through it.

FIGS. 1 and 2 show the device in place with the pin passed through the connector and with the stop members adjusted so as to contact the face of the door 30 and the wall surface or door jamb 31. When the device is in the position shown in FIGS. 1 and 2, it is believed apparent that it is impossible to open the door because of the contact of the stop members with the wall 31 and door 30.

Figure 3:
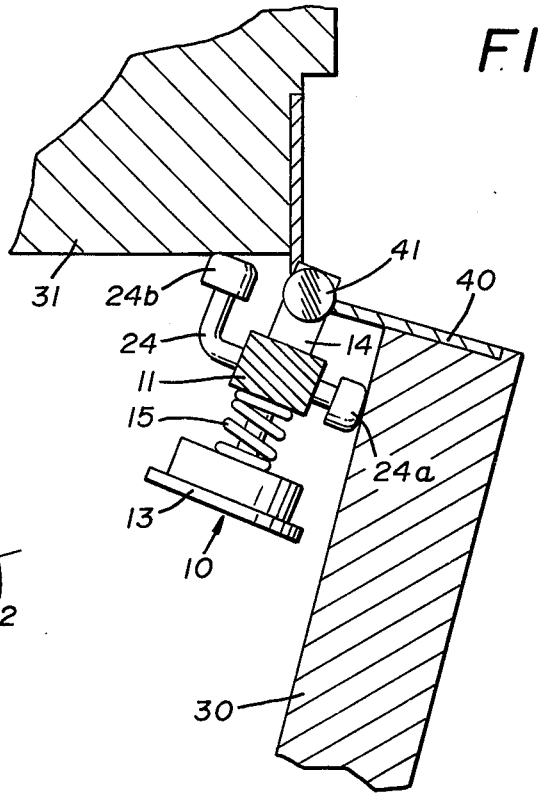
FIG. 3 is a partial sectional view taken along the line 3—3 of FIG. and showing the device in its rotated position.

When it is desired to utilize the door in conventional fashion, it is simply necessary to turn handle 13 to reduce tension on spring 15 and then rotate the device 90 degrees about the longitudinal axis of rod 12 as shown in FIG. 3. At that point auxiliary stop member 24 comes into play, and one end 24*a* thereof will contact the door 30, while the other end 24*b* will contact the wall 31 to prevent the door from being opened to an extent to which the door handle would damage the wall. Other than that, however, the door will function in its normal fashion. It should be noted at this point that the stop members 20, 21, 22, and 23 are not utilized and do not in any way interfere with the normal operation of the door.

Figure 4:
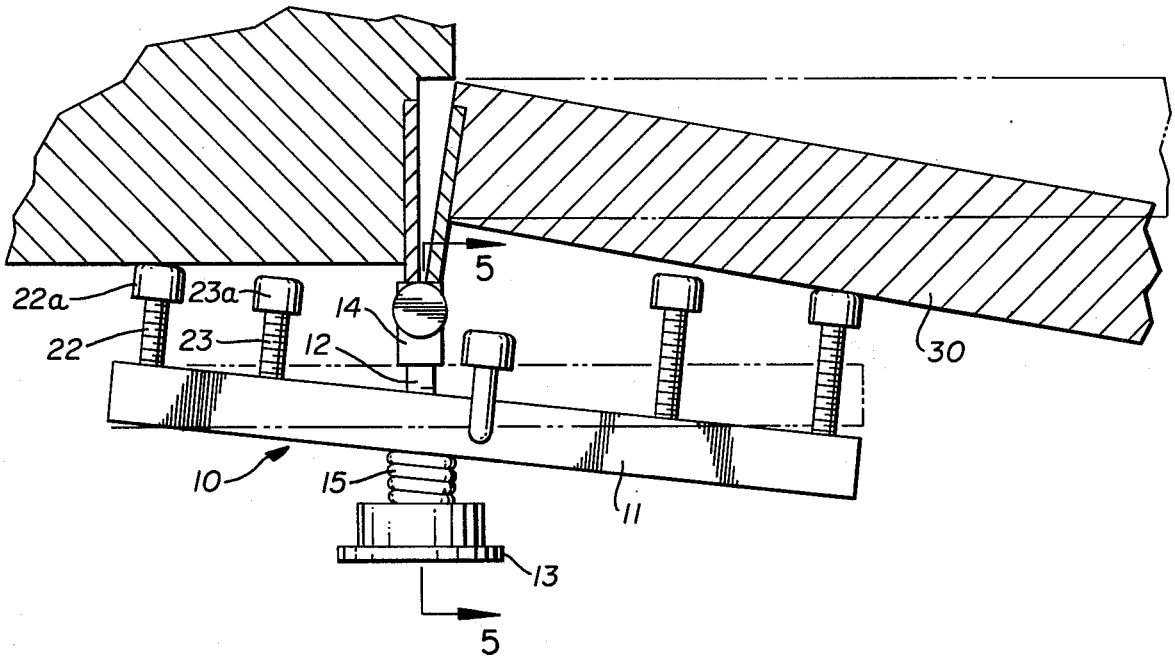
FIG. 4 is a view similar to FIG. 2 showing the adjustment feature permitting partial opening of the door.
Figure 5:
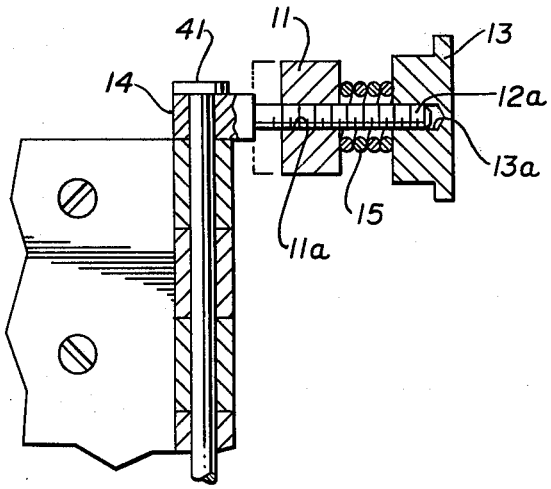
FIG. 5 is a sectional view taken along the line 5—5 of FIG. 4.

It should be noted, as mentioned above, that the rod 12 is threaded as at 12*a*. The handle 13 also has a threaded bore 13*a* so that the handle may be advanced along the rod 12*a*. Since the spring 15 is trapped between the bar 11 and the handle 13, loosening of the handle in a counter-clockwise direction will permit partial opening of the door as shown in FIG. 4 of the drawings. This would permit the occupant of the room to open the door partially to ascertain the identity of someone on the outside of the door without sacrificing the security aspects of the lock itself. Turning the handle 13 in a clockwise direction will, of course, increase tension on the spring member 15 and prevent such partial opening.

The spring 15 also has an additional advantage when the device is rotated as shown in FIG. 3 in that it will serve to maintain the bar 11 in a vertical position and avoid any accidental tilting which would interfere with the normal operation of the door.

The device is intended to be portable and could be carried by travelers, for example, and all that is necessary for installation of the same is to remove one hinge pin 41, following which the hinge pin can be reinserted passing it through the aperture in the connector 14, and the device is in operative position.

It should be noted that the bar is normally intended to be made of metal but could be made of any suitable rigid material capable of being threaded and capable of receiving the stop members.

It should also be noted that the device has been illustrated as being utilized in connection with the middle hinge of the door but could, of course, be utilized with the upper or lower hinge, as desired.

Furthermore, while two stop members have been shown on each end of the bar, it is believed apparent that the operative principle of the invention could be employed with more or less than that number of stop members.

While a full and complete description of the invention has been set forth in accordance with the dictates of the Patent Statutes, it should be understood that modifications can be resorted to without departing from the spirit hereof or the scope of the appended claims.

What is claimed is:

1. An auxiliary lock for use in connection with a door hinge, comprising;

A. an elongate cross bar;

B. a plurality of adjustable stop members carried by and projecting from one side of said cross bar; and C. spring-loaded connecting means

1. carried by said cross bar between said stop members and

2. adapted to engage the door hinge and normally urging said cross bar toward the door hinge.

2. The lock of claim 1 wherein said stop members are carried by said cross bar adjacent its opposed ends.

3. The lock of claim 1 wherein said connecting means are rotatably carried by said cross bar.

4. The lock of claim 3 wherein said connecting means include:

A. an elongate threaded rod carried by and projecting from opposed sides of said cross bar;

B. a connector

1. carried by one end of said rod and

2. having a through aperture therein a. whereby the hinge pin of the door hinge may be passed therethrough; and C. a handle threadedly carried on the opposed end of said rod.

5. The lock of claim 4 further characterized by the presence of a spring surrounding said rod and being disposed between the side of said cross bar and said handle.

6. The lock of claim 1 further characterized by the presence of auxiliary stop members carried by said cross bar in opposed relation to each other and projecting therefrom.

7. An auxiliary lock for attachment to a door hinge comprising;

A. an elongate cross bar;

B. at least one first stop member adjustably carried by and projecting from one side of said cross bar adjacent one end thereof;

C. at least one second stop member adjustably carried by and projecting from the same side of said cross bar as said first stop member adjacent the opposed end thereof; and D. spring-loaded connecting means carried by and projecting from the same side of said cross bar and adapted to engage said hinge and normally urging said cross bar toward said hinge.

* * * * *